US005810478A

United States Patent [19]

LaFleur

[11] Patent Number: 5,810,478

[45] Date of Patent: Sep. 22, 1998

[54] BULK BAG WITH LIFT STRAPS AND EXTERIOR LINER

[75] Inventor: Lee LaFleur, Manistee, Mich.

[73] Assignee: Custom Packaging Systems, Inc., Manistee, Mich.

[21] Appl. No.: 806,331

[22] Filed: Feb. 26, 1997

[51] Int. Cl.[6] ..... B65D 33/14

[52] U.S. Cl. ..... 383/24; 383/41; 383/63; 383/97; 383/111

[58] Field of Search ..... 383/17, 18, 19, 383/22, 24, 41, 63, 67, 97, 105, 109, 111, 113

[56] References Cited

U.S. PATENT DOCUMENTS

| | | | |
|---|---|---|---|
| Re. 35,270 | 6/1996 | Polett | 383/24 |
| 4,113,146 | 9/1978 | Williamson | 383/18 X |
| 4,362,199 | 12/1982 | Futerman . | |
| 4,390,051 | 6/1983 | Cuthbertson | 383/111 |
| 4,597,102 | 6/1986 | Nattrass | 383/113 X |
| 4,781,472 | 11/1988 | LaFleur et al. | 383/105 X |
| 4,807,299 | 2/1989 | Nattrass et al. | 383/19 X |
| 4,874,258 | 10/1989 | Marino | 383/111 |
| 4,909,410 | 3/1990 | Derby et al. | 383/119 X |
| 5,104,236 | 4/1992 | LaFleur . | |
| 5,529,393 | 6/1996 | Polett | 383/24 |
| 5,542,765 | 8/1996 | Smith et al. | 383/17 |

*Primary Examiner*—Jes F. Pascua
*Attorney, Agent, or Firm*—Barnes, Kisselle, Raisch, Choate, Whittemore & Hulbert, P.C.

[57] ABSTRACT

For a bulk bag with lift straps, an exterior liner with an opening adjacent each lift strap constructed to receive the lift strap therethrough so that the bag can be lifted by its lift straps with the liner in place. To prevent leakage and to protect the contents of the bag from water or other contaminants, a closure member is provided for each opening to substantially seal the opening. Preferably, each closure member has two opposing surfaces with fingers extending therefrom and constructed to releasably interlock when the opposing surfaces are mated together to seal the opening.

12 Claims, 2 Drawing Sheets

BULK BAG WITH LIFT STRAPS AND EXTERIOR LINER

FIELD OF THE INVENTION

This invention relates to shipping and storage containers and more particularly to a collapsible container in the form of a bag of a flexible material and an exterior liner.

BACKGROUND OF THE INVENTION

Previously, many granular products and some liquids have been shipped and stored in large bulk bags which may contain as much as a ton or more of material. Some of these bulk bags are flexible and when empty can be folded to a generally flat condition. One such flexible bag is disclosed and claimed in U.S. Pat. No. 5,104,236.

These flexible bags have generally rectangular ends interconnected by generally rectangular side walls and, when filled, can be stacked one on top of another. For some applications the bags are made of a woven fabric and for other applications a plastic material. For some applications, and particularly for storing liquids or hazardous materials, a bag of a water impervious plastic material is received in and reinforced and protected by a bag of a woven fabric. Usually, these bags have a spout in one or both ends for filling and emptying the bags. Further, for some applications, it is desirable to have a bag of a water impervious plastic material encasing a bag of woven fabric to protect the contents of the inner bag and to contain the contents of the inner bag that leak through the inner bag.

U.S. Pat. No. 4,362,199 discloses a bulk bag of woven fabric with lift straps attached to selected reinforced areas of the fabric. While filled, the bag is lifted, moved and supported by these lift straps. In applications where a bag of a water impervious plastic material encases the woven bag, the lift straps are also encased within the outer bag which makes lifting, moving and filling of the bags difficult. Further, because the bag is not supported adjacent its corners by lifts straps during filling, the corners of the bag can collapse and decrease the interior volume of the bag. Still, further, with the lift straps enclosed within the outer bag, it is more difficult to move a filled bag which increases the likelihood of rupturing the outer bag and compromising the protection provided to the inner bag and its contents.

SUMMARY OF THE INVENTION

According to the present invention, an exterior liner for a bulk bag having lift straps is provided. The liner has openings constructed to receive the lift straps of the bag therethrough and closure members adjacent each opening in the liner to substantially seal each opening and thereby protect the inner bag and its contents. Preferably, the lift straps are formed from a flexible material such that they may be folded down into the opening of the liner when not in use allowing the closure member to completely close the opening.

To facilitate filling the bag, the inner bag preferably has an access opening through its top wall. In this instance, the liner preferably also has an opening adjacent to the access opening of the inner bag and a corresponding closure member so that the access opening can be sealed to prevent leakage of the contents from the inner bag after it has been filled.

The closure members preferably provide a substantially water-tight and air-tight seal to prevent the contents of the inner bag from leaking or escaping through the exterior liner. Preferably, the closure members releasably seal the openings and can be manually reopened and reclosed as needed. Preferably, the closure members have two opposed surfaces extending from the bag and capable of being mated together. Also preferably, each surface has at least one finger extending therefrom and is constructed to interlock with a complementary shaped finger of the opposing surface to substantially seal the opening. In the preferred embodiment, two fingers are provided spaced apart on one surface and two fingers are provided on the opposing surface such that the two fingers on the opposing surface are received in between the fingers of the other surface providing an interlocking fit. In addition to an interlocking fit, to provide a substantially water-tight and air-tight seal, the fingers preferably mate with a snap fit or interference fit.

Objects, features and advantages of this invention are to provide an exterior liner for a collapsible bag with lift straps which facilitates movement and filling of the inner bag when the exterior liner is in place, allows access to the lift straps of the inner bag, allows the inner bag to be supported by the lift straps during filling, provides a substantially water-tight and air-tight barrier around the inner bag containing any leakage of any of the contents of the inner bag, provides for manual reopening and resealing of the exterior liner, protects the inner bag from water or other contaminants, retains the liner adjacent the bag during filling and emptying of the bag, is effective, reliable, reusable, and is of relatively simple design and economical manufacture.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
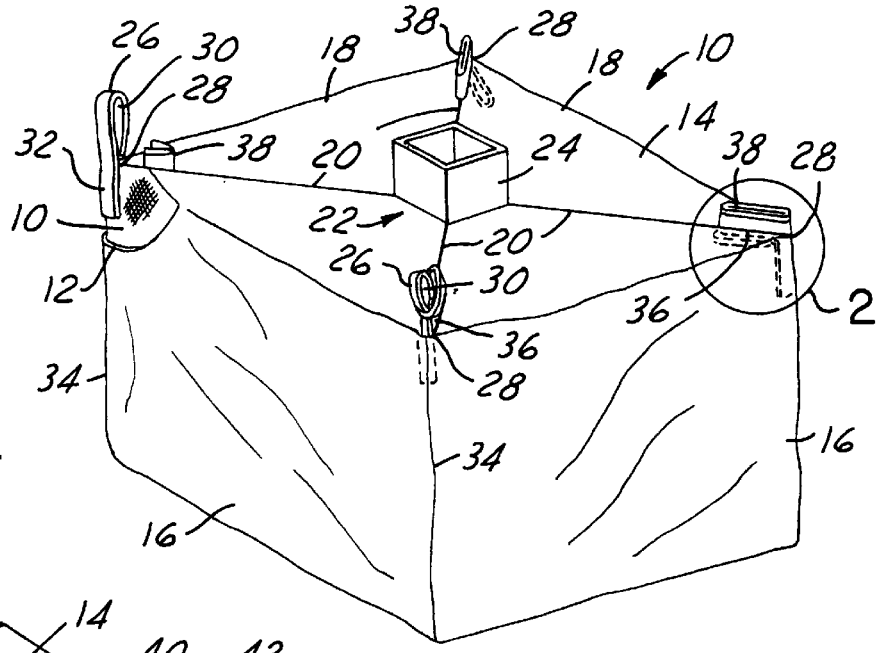
FIG. 1 is a perspective view of a bulk bag encased in a liner embodying this invention.

Referring in more detail to the drawings, FIG. 1 shows a bulk bag 10 with a liner 12 disposed adjacent the exterior of the bag 10 to protect the contents of the bag 10 and to prevent leakage of the contents. The bulk bags 10 are used for applications where containers or bags of great strength are needed and they may be made from a woven fabric material, such as woven polyethylene and woven polypropylene fabrics. If a leak proof and high strength container is required, another bag of a plastic film can be received in a bag 10 of a woven fabric with both bags 10 having the same general configuration. A presently preferred bulk bag 10, inner liner bag, and a method of making them is disclosed and claimed in U.S. Pat. No. 4,790,029 the disclosure of which is incorporated herein by reference. This method may also be used to make the walls and the general configurations of the exterior liner 12.

When formed, the bags 10 and liners 12 each have a generally cubicle configuration with a pair of generally square ends 14 interconnected by four generally rectangular side walls 16. To facilitate folding when the bag 10 is empty, preferably a pair of the opposed side walls 16 have gussets therein. Each end has four triangular portions 18 integral with the side walls 16 and having their edges 20 connected together to form the end 14. To facilitate filling and/or emptying of the bag 10, an access opening 22 is provided in at least one end of the bag 14. Preferably, a spout 24 is provided in each access opening 22. Preferably, the spout 24 is a separate circumferentially continuous tube of the same material as the bag 10 and one end of the spout 24 is inserted in the opening and connected to the associated triangular portions forming the end of the bag by a series of stitches, a heat seal or other mechanical means.

To facilitate lifting and moving the bag 10, lift straps 26 are preferably attached adjacent at least two generally opposed upper corners 28 of the bag and more preferably, adjacent all four upper corners 28 of the bag 10. Preferably, each lift strap 26 is in the form of a loop of a flexible material having a bight 30 and two runs 32 with its runs 32 connected to the side 16 of the bag 10 adjacent a side edge 34 and the top of the bag 10.

Referring again to FIG. 1, a liner 12, preferably constructed of a flexible water impervious material such as a film of plastic, is disposed adjacent to the exterior of the bulk bag 10 and has openings 36 adjacent to the lift straps 26 of the bag 10 constructed to receive the lift straps 26 therethrough to facilitate moving and lifting the bag 10. To provide a substantially air-tight and liquid-tight seal of each opening 36, a closure member 38 is disposed adjacent each opening 36. If a spout 24 is provided in one or both ends 14 of the bag 10, an opening 36 is preferably also provided adjacent each spout 24 with an associated closure member 38 to seal the opening 36. In use, when the lift straps 26 or spout 24 are not needed they may be tucked down into the opening 36 and received between the liner 12 and the bag 10 so that the closure members 38 can substantially completely seal the opening 36 of the liner 12.

Figure 2:
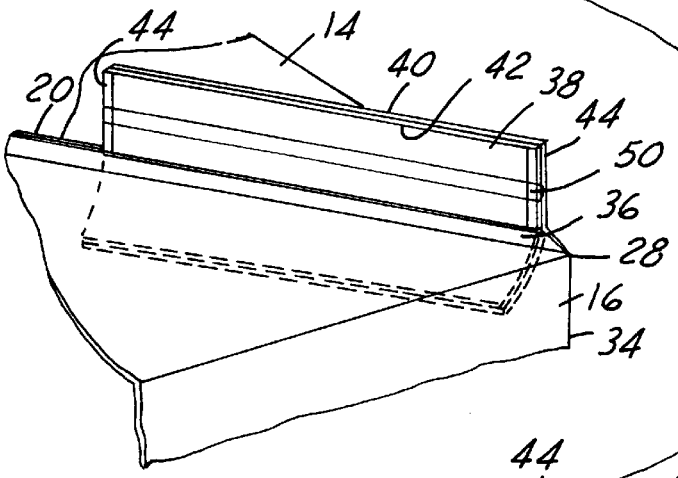
FIG. 2 is an enlarged fragmentary view showing a closure member sealing an opening of the liner.
Figure 3:
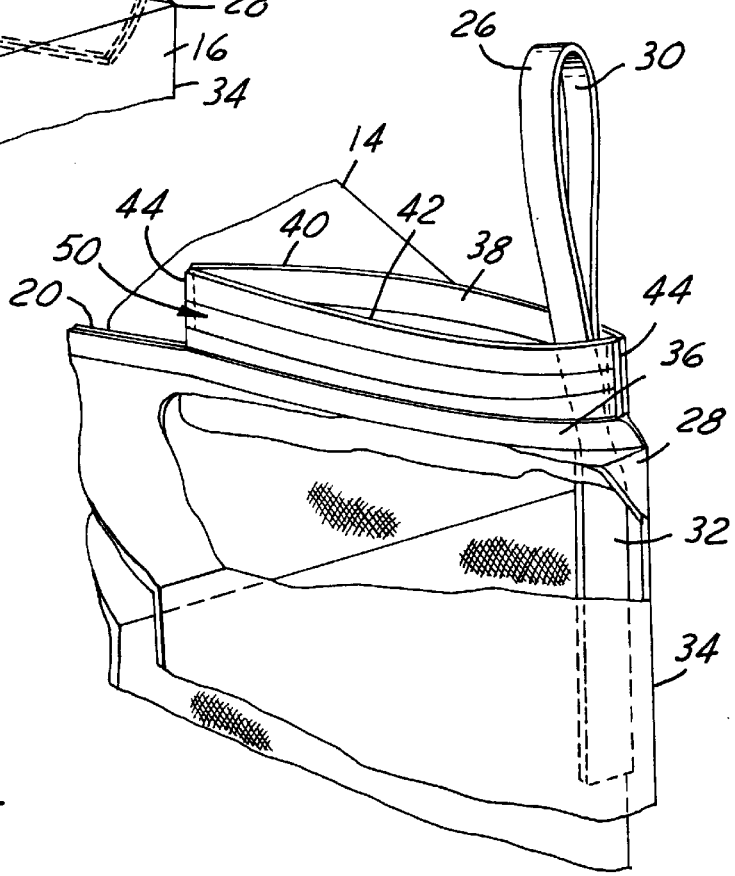
FIG. 3 is an enlarged fragmentary view showing a lift strap extending through an opening of the liner.

As shown in FIG. 2, each closure member 38 preferably has a continuous loop or sleeve with two opposed wall portions or faces 40, 42 of a flexible material such as plastic film which, when mated together, substantially completely seal the opening 36. Also preferably, to prevent leakage between the closure members 38 and the liner 12, the sleeve and wall portions of each closure member 38 extends beneath the liner 12 and is permanently affixed and sealed to the liner 12 such as by a heat seal. Preferably, to ensure a sufficient seal adjacent the edges 44 of the closure member 38 and to align the wall faces 40, 42 adjacent each other, the two wall portions 40, 42 of the closure member 38 are heat sealed or otherwise connected to each other adjacent their edges 44. Preferably, the free ends of the wall portions 40, 42 of the closure member 38 are constructed to be releasably mated together such that they can be manually reopened and resealed allowing for reuse of the liner 12 and closure members 38. As shown in FIG. 3, the wall portions 40, 42 of the closure member 38 can be separated along their entire length (with the exception of their ends 44 which are heat sealed together) and the lift strap 26 can be pulled through the opening 36 and the closure member 38 so that the bag 10 can be carried and moved by the lift straps 26.

Figure 4:
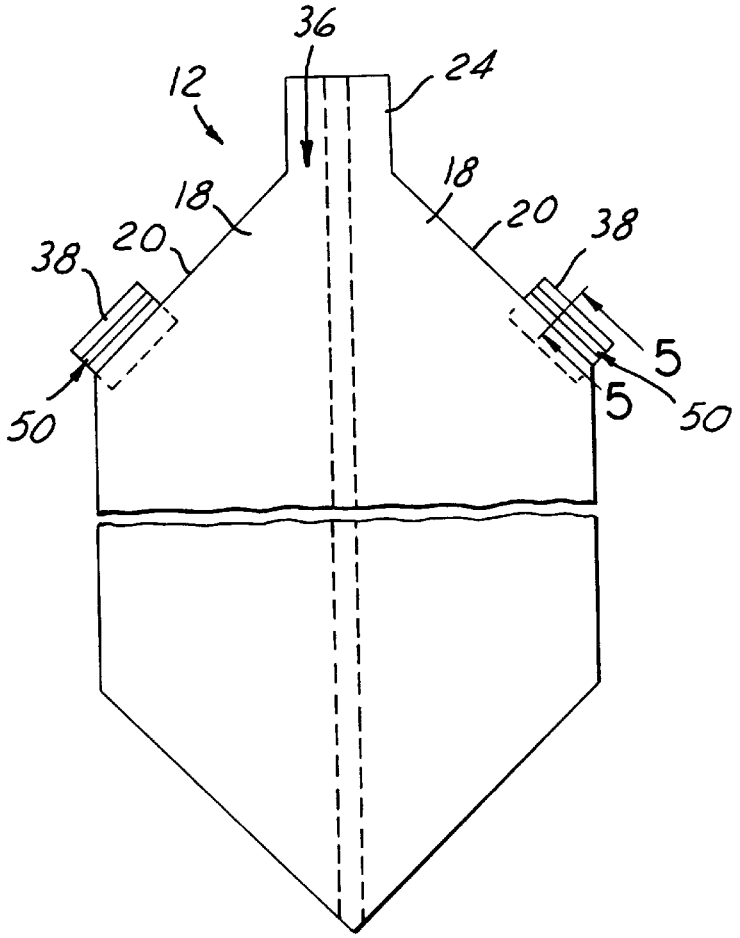
FIG. 4 is a plan view of a liner of this invention when collapsed.

To facilitate attaching the closure members 38 adjacent to the liner 12, the liner 12 is preferably folded into the configuration shown in FIG. 4. In this configuration, the closure members 38 can be heat sealed to the liner 12 at the same time that adjacent sides 20 of adjacent triangles 18 are heat sealed together to form the ends 14 of the bag 10. To prevent the entire length of the openings 36 and the closure members 38 from being sealed together, a plate or block of material with low heat conductivity such as Teflon® is placed between the opposing wall portions 40, 42 of each closure member 38 and opening 36 to inhibit heat transfer from one surface 40 of the closure member to the other 42 thereby preventing the opposing surfaces 40, 42 of the closure member 38 and opening 36 from being heat sealed together.

Figure 5:
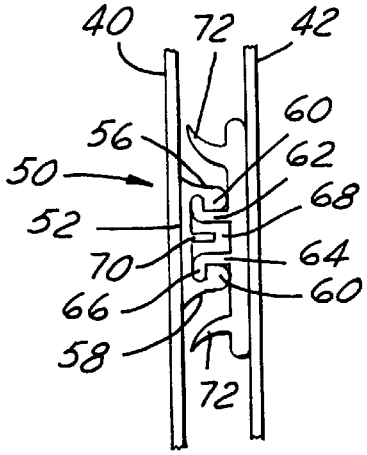
FIG. 5 is an enlarged fragmentary view showing the two surfaces of the closure member when mated.

As shown in FIGS. 4 & 5, a releasable seal assembly 50 such as a zipper extends longitudinally across the wall portions 40, 42 of each closure member adjacent the free ends or outer ends of the closure. The seal assembly may be repeatedly opened and closed and when closed provides a substantially air tight and water tight seal. The preferred seal assembly 50 has two complimentarily mating longitudinally extending strips 52 and 54 each of a flexible plastic material which are each sealed, such as by a heat seal, to the inner face of one of the wall portions 50, 52.

The strip 52 has a pair of longitudinally extending and laterally spaced apart fingers 56, 58 projecting therefrom each having a rib 60 extending inwardly towards a channel 59 defined by the fingers 56, 58. The strip 54 has a pair of longitudinally extending and laterally spaced apart fingers 62, 64 projecting therefrom each with a rib 66 extending outwardly, away from a channel 68 defined by the fingers 62, 64. The fingers 56, 58 on the strip 52 are disposed slightly further apart than the fingers 62, 64 on the strip 54 and are constructed to receive its fingers 62, 64 therebetween for mating and interlocking engagement therewith. Preferably, the ribs 60, 66 of the opposing fingers 56, 62 and 58, 64 interlock with a snap fit or interference fit when the two strips 52, 54 are pressed and mated together. Preferably, to ensure a secure fit and a substantially air-tight and water-tight seal between the fingers, the strip 52 is provided with a separator rib 70 along the interior of its channel 59 which acts to force the fingers 62, 64 of the strip 54 apart and into firm contact with the fingers 56, 58 of the strip 52. Also preferably, to facilitate pressing the strips together the strip 54 can be provided with additional fingers 72 which, when the strips are assembled, are spaced from and adjacent the fingers 56 and 58.

Figure 6:
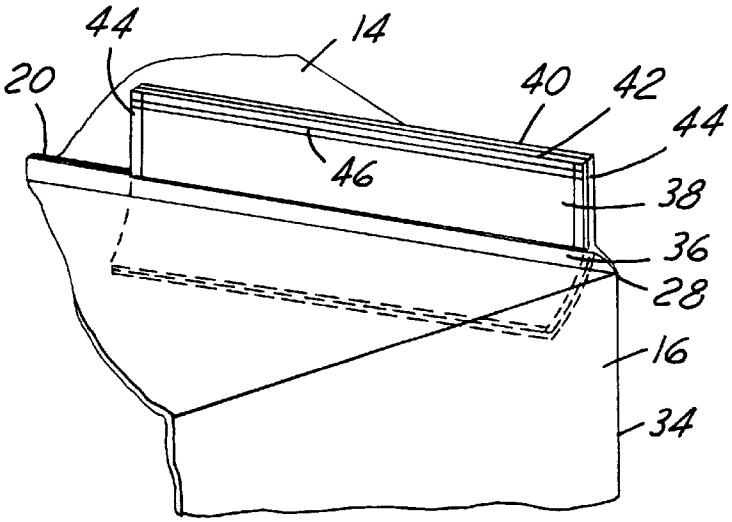
FIG. 6 is an enlarged fragmentary view showing a closure member heat sealed to close an opening in the liner.

Alternatively, as shown in FIG. 6, to completely close and seal the openings 36 the wall portions 40,42 of the closure members 38 are connected together by a heat seal 46. To access the lift straps 26 within the openings 36 after the closure members 38 have been sealed, the closure members 38 are severed between the heat seal 46 and the liner 12. To permit the liner 12 to be reused, the heat seal 46 is preferably disposed adjacent the upper edge of each wall portion 40,42 so that after severing the liner to access the lift straps 26 sufficient wall portion 40,42 material remains to permit subsequently again heat sealing the wall portions 40,42 together.

In use, the bulk bag 10 is disposed interiorly of the liner 12 and is filled with a suitable material preferably through a spout 24 in the top wall 14 of the bag 10 which extends through an opening 36 of the liner 12. When the bag 10 is full, the spout 24 is closed off and tucked down beneath the liner 12 between the liner 12 and the bag 10, and the opening 36 adjacent to the spout 24 is sealed by mating the opposing wall portions of the closure member 38 adjacent to that opening 36. The bag 10 can then be lifted and moved by its lift straps 26 which are exposed through the openings 36 adjacent the corners 28 of the bag 10. This also allows the bag 10 to be supported by its lift straps 26 while it is being filled or emptied and retains the liner 12 adjacent to the bag

10 during discharge of the contents of the bag 10 to prevent the liner 12 from slipping off of the bag 10 and fouling the discharged contents or adjacent machinery. When the lift straps 26 are no longer needed they may be folded down into the liner through their associated openings 36 and received between the liner 12 and the bag 10 whereupon the openings 36 can be sealed by their adjacent closure members 38. Thus, with the openings 36 and associated closure members 38, the bag 10 within the liner 12 can be easily accessed without compromising the protection of the bag 10 provided by the liner 12 from leakage of the contents of the bag 10 or from water or other contaminants from entering the bag 310.

I claim:

1. A collapsible bag having generally rectilinear sides and lift straps adjacent at least two generally opposed corners of the bag comprising:

an exterior liner of a flexible and water impervious material constructed to receive the bag therein;

an opening in the liner adjacent each lift strap of the bag, each opening constructed to receive at least a portion of the lift strap therethrough; and a closure member associated with each opening and capable of substantially sealing such opening, each closure member having first and second strips which are generally opposed and constructed and arranged to be releasably mated together to substantially seal the opening when mated together, whereby the liner is disposed adjacent to and exteriorly of the bag with each lift strap adjacent an opening of the liner, the openings thereafter being substantially sealed by the closure members to prevent leakage of the contents of the bag exteriorly of the liner.

2. The liner of claim 1 wherein the liner has an additional opening and associated closure member adjacent an access opening of the bag.

3. The liner of claim 1 wherein the liner has generally retilinear top, bottom and side walls.

4. The liner of claim 1 wherein the liner is formed from a generally thin-walled and flexible synthetic or plastic film.

5. The liner of claim 1 wherein the closure members provide a substantially air-tight seal.

6. The liner of claim 1 wherein the closure members can be re-opened and re-closed.

7. The liner of claim 1 wherein the first strip has at least one channel extending generally longitudinally of the first strip and the second strip has at least one complementary shaped finger extending generally longitudinally of the second strip and constructed to be releasably received in the channel of the first strip to substantially seal the opening.

8. The liner of claim 1 wherein the first strip has a pair of transversely spaced apart fingers extending generally longitudinally of the first strip and defining a channel therebetween and the second strip has at least one finger extending generally longitudinally of the second strip and constructed to be received in the channel between the pair of fingers of the first strip.

9. The liner of claim 8 wherein the second strip has two fingers constructed to be received in the channel between the pair of fingers of the first strip.

10. The liner of claim 9 wherein each finger has a rib extending generally transversely of the finger and constructed to interlock with a complementary rib of an adjacently received finger.

11. The liner of claim 1 wherein the closure also comprises first and second generally opposed wall portions, the first and second strips are permanently attached to the first and second wall portions and substantially sealed to each other adjacent their ends.

12. The liner of claim 1 wherein the closure member comprises a zipper.

* * * * *